US008113286B2

(12) United States Patent
Beall et al.

(10) Patent No.: US 8,113,286 B2
(45) Date of Patent: Feb. 14, 2012

(54) DOWNHOLE BARRIER VALVE

(75) Inventors: Clifford H. Beall, Broken Arrow, OK (US); Michael J. May, Broken Arrow, OK (US); James T. Sloan, Broken Arrow, OK (US); Andrew Haynes, Houston, TX (US); Thad D. Andrews, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 139 days.

(21) Appl. No.: 12/054,809

(22) Filed: Mar. 25, 2008

(65) Prior Publication Data

US 2008/0223581 A1 Sep. 18, 2008

Related U.S. Application Data

(63) Continuation-in-part of application No. 11/595,596, filed on Nov. 9, 2006.

(51) Int. Cl.
*E21B 34/14* (2006.01)

(52) U.S. Cl. ..... 166/332.3; 166/334.2; 166/323

(58) Field of Classification Search ..... 166/332.3, 166/334.2, 323
See application file for complete search history.

(56) References Cited

U.S. PATENT DOCUMENTS 3,346,937 A 10/1967 Folkerts
3,886,967 A * 6/1975 Nelson ..... 137/495
3,971,438 A 7/1976 Crowe
4,103,744 A 8/1978 Akkerman
4,130,166 A 12/1978 Akkerman et al.
4,197,879 A 4/1980 Young
4,289,165 A 9/1981 Fredd
4,293,038 A 10/1981 Evans
4,325,434 A 4/1982 Roberts
4,332,267 A 6/1982 Evans
4,368,871 A 1/1983 Young
4,406,328 A 9/1983 Brooks
4,415,037 A 11/1983 Brooks
4,446,922 A 5/1984 Bowyer et al.
4,449,587 A 5/1984 Rodenberger et al.
4,467,870 A * 8/1984 Langham ..... 166/321
4,475,598 A 10/1984 Brakhage, Jr. et al.
4,476,933 A 10/1984 Brooks (Continued)

OTHER PUBLICATIONS

Brown, Irvine, "A Successful Completion/Perforation by Use of a Downhole Lubricator Vavle: A Case Study from the Siri Filed, Danish Sector, North Sea", SPE 63113, Oct. 2000, 1-7.

(Continued)

*Primary Examiner* — Nicole Coy
(74) *Attorney, Agent, or Firm* — Steve Rosenblatt

(57) ABSTRACT

A ball type downhole barrier valve capable of bidirectional sealing features a ball rotating on its axis to open or close with control line pressure to an actuating rod piston assembly. The ball is also shiftable to a locked open position. A cage surrounds the ball and retains opposed seats to it. The cage is made from one piece and tangential holes are drilled and tapped before the piece is longitudinally split with a wire EDM cutting technique. Fasteners to rejoin the cut halves properly space them to the original one piece internal dimension. Auxiliary tools allow determination of spacing of internal components so that a desired spring preload on the seats against the ball can be achieved. Seals on the sleeves that form ball seats help prevent leakage due to ball distortion at high differential pressures when the valve is closed.

15 Claims, 12 Drawing Sheets

U.S. PATENT DOCUMENTS

| | | | | |
|---|---|---|---|---|
| 4,519,576 | A * | 5/1985 | Winegeart | 251/62 |
| 4,522,370 | A | 6/1985 | Noack et al. | |
| 4,569,397 | A | 2/1986 | Brakhage, Jr. et al. | |
| 4,627,492 | A | 12/1986 | MacLaughlin | |
| 5,417,405 | A | 5/1995 | Stephan et al. | |
| 5,564,675 | A * | 10/1996 | Hill et al. | 251/62 |
| 5,865,246 | A | 2/1999 | Brown | |
| 6,109,352 | A | 8/2000 | Edwards et al. | |
| 6,223,824 | B1 | 5/2001 | Moyes | |
| 6,691,785 | B2 | 2/2004 | Patel | |
| 6,695,286 | B1 | 2/2004 | Florio et al. | |
| 6,708,946 | B1 | 3/2004 | Edwards et al. | |
| 2001/0045285 | A1 | 11/2001 | Russell | |
| 2002/0040788 | A1 | 4/2002 | Hill, Jr. et al. | |
| 2006/0272825 | A1 | 12/2006 | Royer | |
| 2008/0223581 | A1 | 9/2008 | Beall et al. | |

OTHER PUBLICATIONS

Heijnen, W.H.P.M., et al., "Subsurface Safety Valve Developments for Gaswells", SPE 19283-1, Sep. 1989, 6 pages.

* cited by examiner

DOWNHOLE BARRIER VALVE

RELATED APPLICATIONS

This application is a continuation in part of U.S. application Ser. No. 11/595,596 filed on Nov. 9, 2006 and having the title Downhole Lubricator Valve.

FIELD OF THE INVENTION

The field of the invention relates to downhole barrier valves such as, among other applications, a valve for forming a downhole lubricator that allow a string to be made up in a live well by isolation of a lower portion of it and more particularly to features regarding such valves relating to locking them, assembling them and component fabrication techniques.

BACKGROUND OF THE INVENTION

Lubricator valves are valves used downhole to allow long assemblies to be put together in the well above the closed lubricator valve with well pressure further below the closed lubricator valve. These valves are frequently used in tandem with sub-surface safety valves to have redundancy of closures against well pressures below. Valves are also used downhole for other isolation purposes.

Lubricator assemblies are used at the surface of a well and comprise a compartment above the wellhead through which a bottom hole assembly is put together with the bottom valve closing off well pressure. These surface lubricators have limited lengths determined by the scale of the available rig equipment. Downhole lubricators simply get around length limitations of surface lubricators by using a lubricator valve downhole to allow as much as thousands of feet of length in the wellbore to assemble a bottom hole assembly.

In the past ball valves have been used as lubricator valves. They generally featured a pair of control lines to opposed sides of a piston whose movement back and forth registered with a ball to rotate it 90 between an open and a closed position. Collets could be used to hold the ball in both positions and would release in response to control pressure in one of the control lines. An example of such a design can be seen in U.S. Pat. Nos. 4,368,871; 4,197,879 and 4,130,166. In these patents, the ball turns on its own axis on trunnions. Other designs translate the ball while rotating it 90 degrees between and open and a closed position. One example of this is the 15K Enhanced Landing String Assembly offered by the Expro Group that includes such a lubricator valve. Other designs combine rotation and translation of the ball with a separate locking sleeve that is hydraulically driven to lock the ball turning and shifting sleeve in a ball closed position as shown in U.S. Pat. No. 4,522,370. Some valves are of a tubing retrievable style such as Halliburton's PES® LV4 Lubricator Valve. Lock open sleeves that go through a ball have been proposed in U.S. Pat. No. 4,449,587. Other designs, such as U.S. Pat. No. 6,109,352 used in subsea trees have a rack and pinion drive for a ball and use a remotely operated vehicle (ROV) to power the valve between open and closed positions claiming that either end positioned is a locked position but going on to state that the same ROV simply reverses direction and the valve can reverse direction.

What is lacking and addressed by the present invention is a more elegant solution to a downhole ball type lubricator valve. One of the features is the ability to translate the ball for the purpose of locking open a ball that normally rotates between open and closed on its own axis. Another feature is a method of manufacturing parts that must be longitudinally split so that they retain the original bore dimension despite the wall removal occasioned by longitudinally splitting the part. Yet another feature is the ability to assemble components to a given overall dimension so as to accurately set preload on biased seats that engage the ball.

In one embodiment, the annular piston that actuates the valve is replaced with at least one rod piston and the space made available with this change allows the addition of a seal to prevent leakage under high differential pressure conditions from the uphole to the downhole direction.

These and other features of the present invention will be more readily apparent to those skilled in the art from a review of the preferred embodiment and associated drawings that are described below while recognizing that the full scope of the invention is determined by the claims.

SUMMARY OF THE INVENTION

A ball type downhole barrier valve capable of bidirectional sealing features a ball rotating on its axis to open or close with control line pressure to an actuating rod piston assembly. The ball is also shiftable to a locked open position. A cage surrounds the ball and retains opposed seats to it. The cage is made from one piece and tangential holes are drilled and tapped before the piece is longitudinally split with a wire EDM cutting technique. Fasteners to rejoin the cut halves properly space them to the original one piece internal dimension. Auxiliary tools allow determination of spacing of internal components so that a desired spring preload on the seats against the ball can be achieved. Seals on the sleeves that form ball seats help prevent leakage due to ball distortion at high differential pressures when the valve is closed.

DETAILED DESCRIPTION OF THE PREFERRED EMBODIMENT

Figure 1:
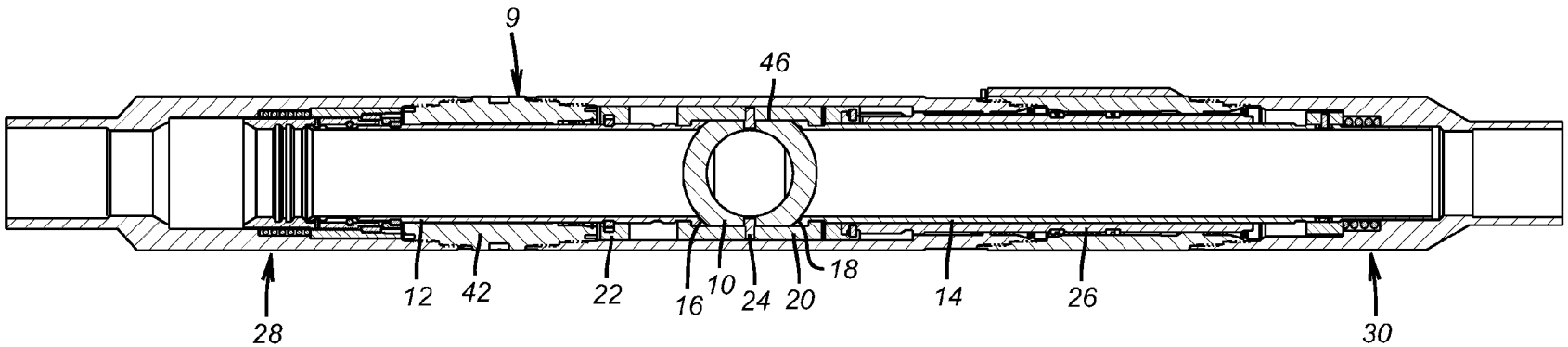
FIG. 1 is a section view of the entire lubricator valve.

FIG. 1 illustrates the layout of the main components in housing 9 to show their position relative to each other with the ball 10 in the center and in the closed position. Sleeve 12 is above ball 10 and sleeve 14 is below ball 10. These sleeves respectively form seats 16 and 18 that are held against ball 10 by a cage 20. Cage 20 is shown in perspective in FIG. 9. A slide 22 extends through cage 20 and registers with ball 10 to rotate it between the open and closed position on trunnions 24. A piston 26 is responsive to control line pressure to reciprocate the slide 22 to operate ball 10. A lock open assembly 28 is disposed near the top of the tool while the preload adjustment mechanism 30 is located near the opposite end. Using this basic locating of the major components of the valve, the other FIGS. will now be used to bring out additional details and explain the basic operation.

Figure 3:
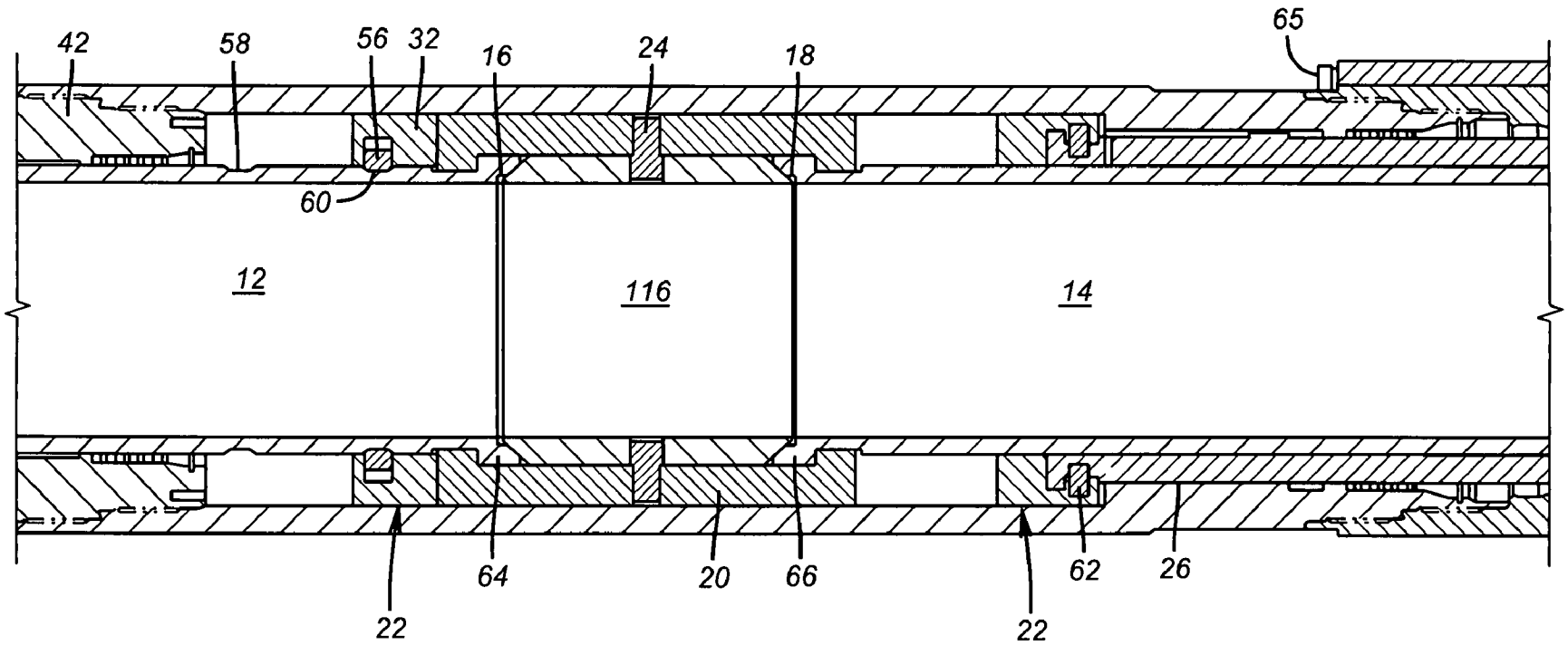
FIG. 3 is a larger view of the middle of the valve from FIG. 1 showing the ball open.
Figure 6:
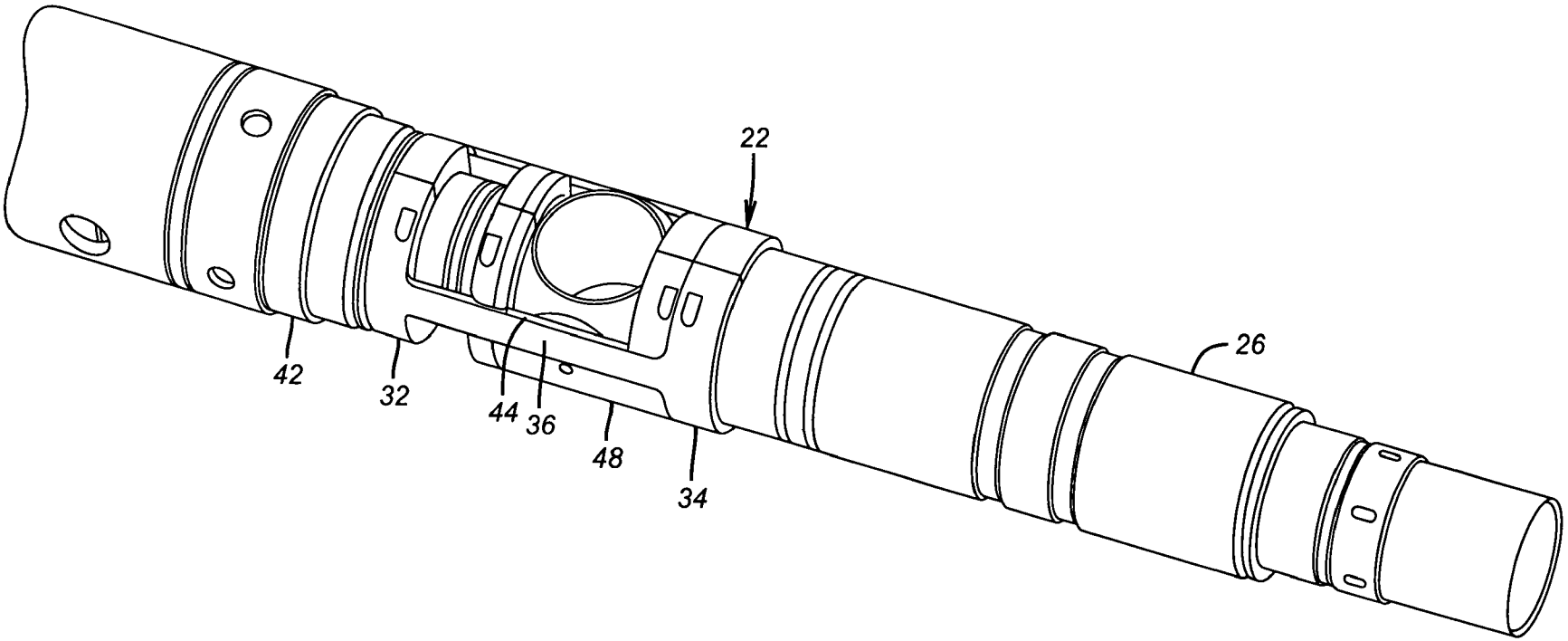
FIG. 6 is a perspective view of the section views shown in FIGS. 4 and 5.
Figure 9:
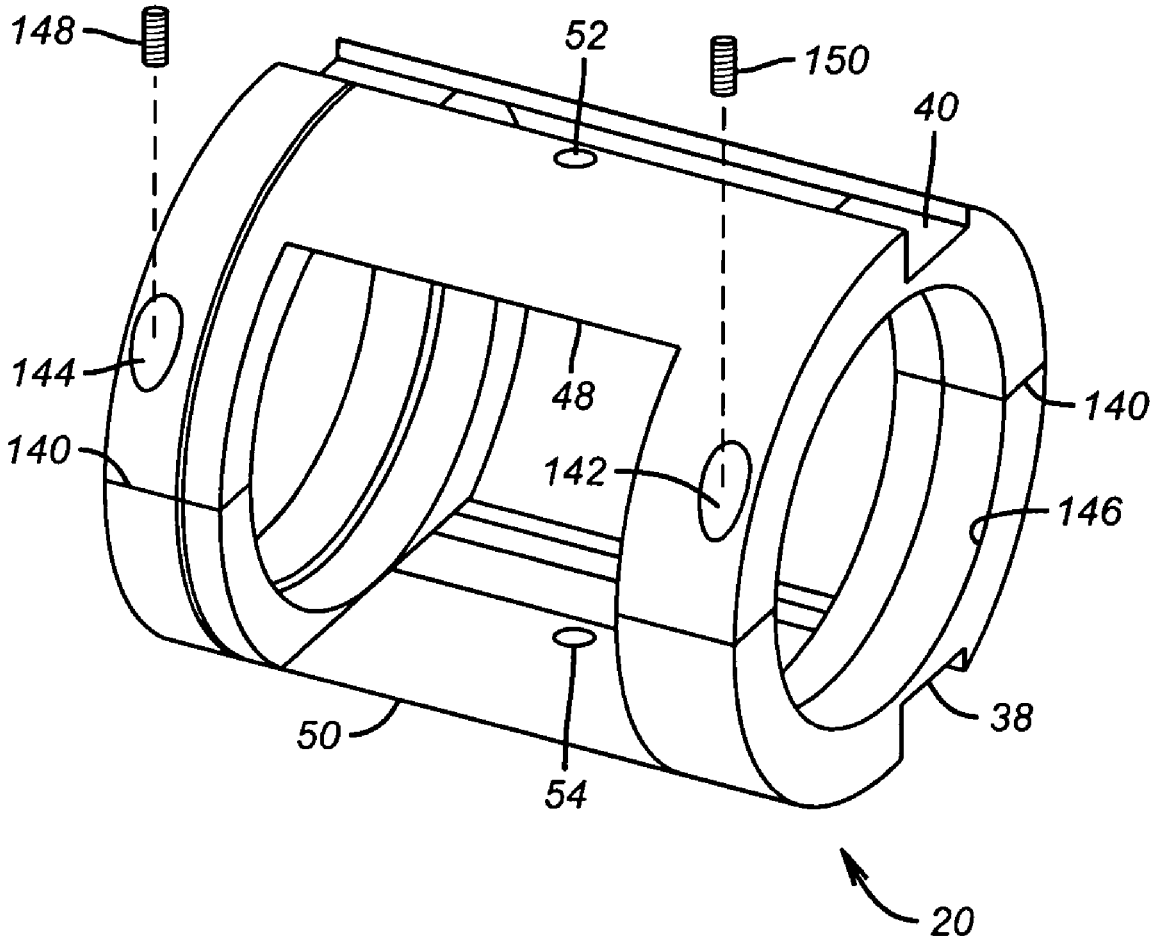
FIG. 9 is a perspective of the cage that surrounds the ball and is longitudinally split.
Figure 10:
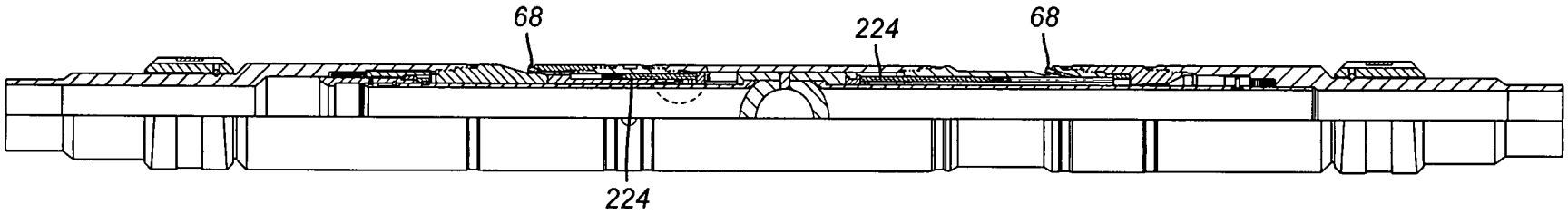
FIG. 10 is a section view of the embodiment showing the use of rod pistons and an additional lower seal to deal with issues of ball distortion under high differential pressures.
Figure 11:
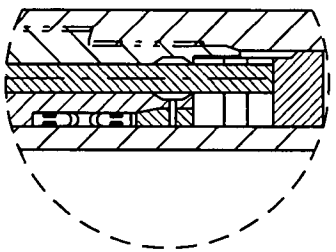
FIG. 11 is an enlarged view of an upper seal around a sleeve that support the upper ball seat.

FIG. 6 can be used to appreciate how the ball 10 is rotated 90 degrees between the closed position shown in FIG. 6 and the open position shown in section in FIG. 3. Piston 26 operates like many pistons known in the art and used in downhole valves. A pair of control lines (not shown) are run from the surface to opposing piston face areas on piston 26 to urge it to move in opposed directions. The piston 26 is secured to the slide 22 for tandem movement. Slide 22 has an upper ring 32 and a lower ring 34 connected by arms 36, one of which is visible in FIG. 6. Looking at FIG. 9 it can be seen that the cage has longitudinal slots 38 and 40 that accept the arms 36 of slide 22. Referring to FIGS. 1 and 6 it can be seen that slide 22 is at the end of its uphole stroke as it has contacted the mandrel 42. Ball 10 has opposed angled exterior slots 44 one of which is partially in view in FIG. 6. The slots 44 are parallel to each other on opposed flats 46 better seen in FIG. 1. Flats 46 on ball 10 abut arms 48 and 50 of cage 20 as best seen in FIGS. 6 and 9. Holes 52 and 54 accept trunnions 24 that extend into ball 10 to allow it to rotate on its own axis. Cage 22 does not move but when slide 22 is moved by piston 26 the result is rotation of ball 10 on its own axis. This happens because arms 36 have inwardly facing pins (not shown) that register with slots 44 in ball 10 off center from trunnions 24 to induce rotation of ball 10.

Figure 4:
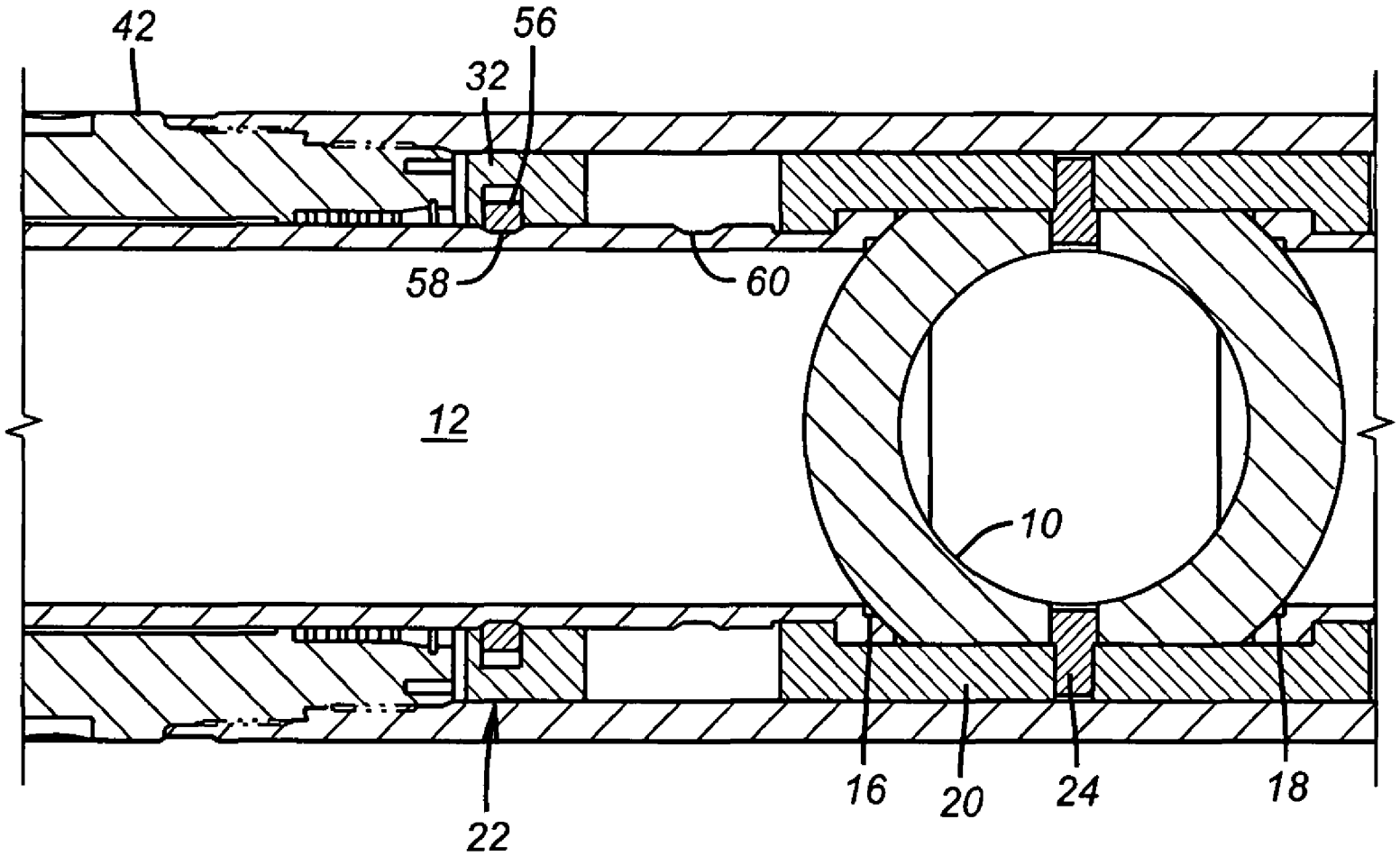
FIG. 4 is an alternate view to FIG. 3 showing the ball closed.

To better see this movement, FIGS. 3 and 4 need to be compared. FIG. 4 shows the ball 10 in a closed position and upper ring 32 close to mandrel 42 but not in contact. This is because, optionally, a snap ring 56 registers with slot 58 on sleeve 12 to hold the ball 10 in a closed position until enough pressure is exerted on piston 26 to pop the snap ring 56 out of groove 58 until it registers with groove 60 to define the open position of FIG. 3. Again, in FIG. 4 during normal opening and closing of the ball 10, the only moving part except ball 10 shown in that FIG. is slide 22 with ring 56. FIG. 3 shows the fully open position of ball 10 with ring 56 registering with groove 60. Slide 22 may optionally contact cage 20 at this time. FIG. 3 also shows piston 26 attached to slide 22 with an anti-rotation pin 62. One of the control line connections 65 to operate piston 26 is also shown in FIG. 3. FIG. 3 also shows that sleeves 12 and 14 respectively form flanges 64 and 66 and how the cage 20 retains those flanges together against ball 10. Seals 16 and 18 respectively are disposed in flanges 64 and 66 for circumferential sealing contact with ball 10 as it rotates between the open and the closed positions of FIGS. 3 and 4.

Figure 5:
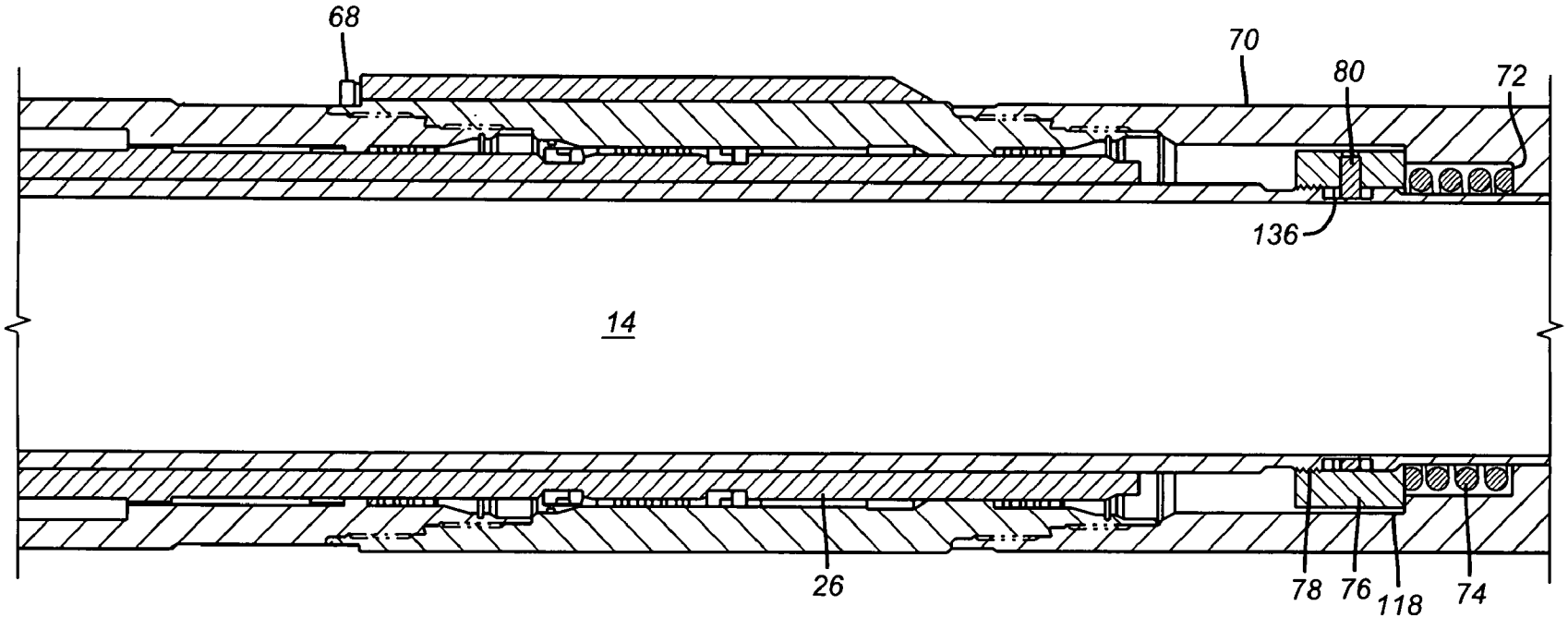
FIG. 5 is a larger view of the lower end of the valve of FIG. 1.

Looking now at FIG. 5, the lower end of the sleeve 14 can be seen as well as another control line connection 68 that is used to urge piston 26 in an opposite direction from pressure applied to connection 65 shown in FIG. 3. A bottom sub 70 has a shoulder 72 on which a spring 74 is supported. Spring 74 pushes on ring 76 that is attached to sleeve 14 with a thread 78. A screw 80 locks the position of ring 76 after that position is initially determined in a procedure that will be explained below. In essence, spring 74 is a preload spring on an assembly that begins with ring 76 and extends to the upper end of the valve shown in FIG. 2.

Figure 2:
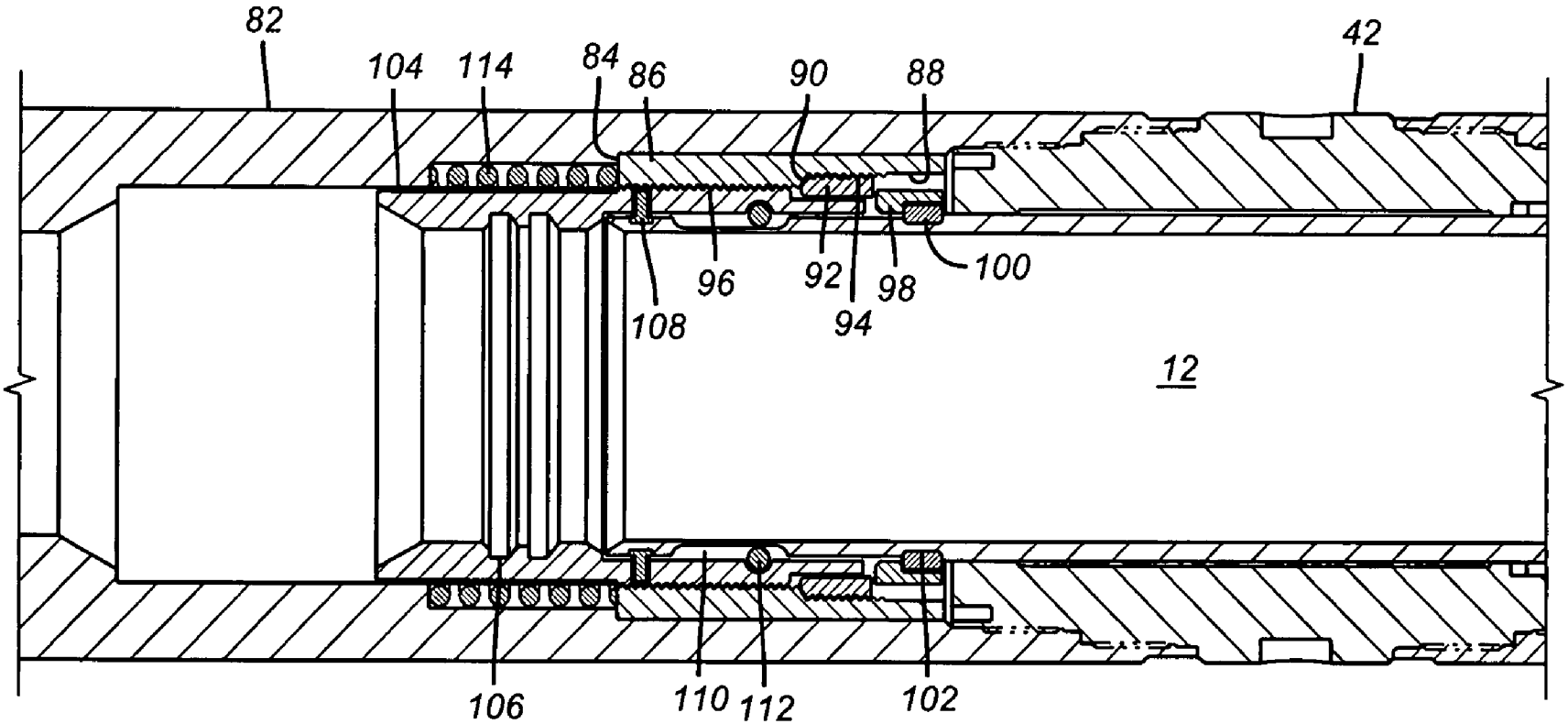
FIG. 2 is a larger view of the top end of the valve of FIG. 1.
Figure 7:
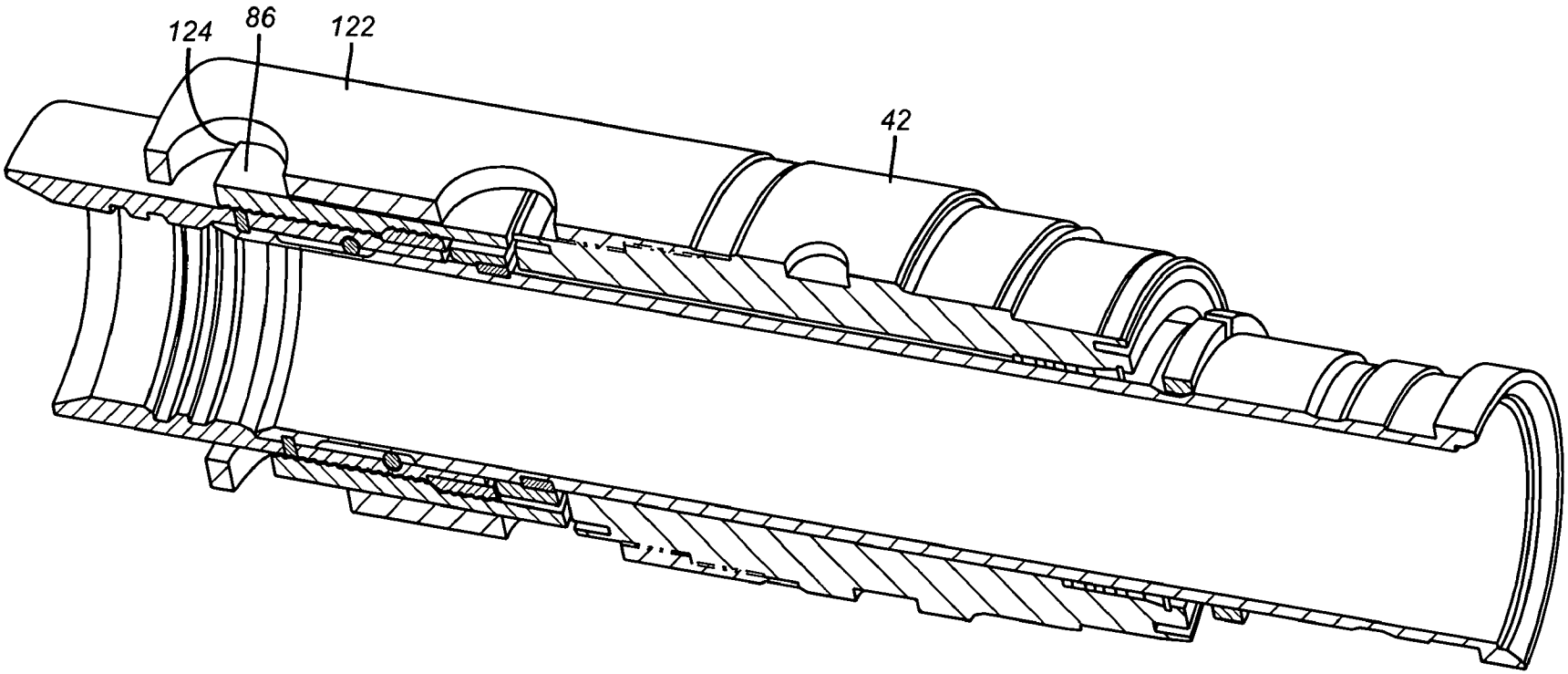
FIG. 7 shows the top end of the valve in FIG. 1 during assembly to get proper spacing of internal components.
Figure 8:
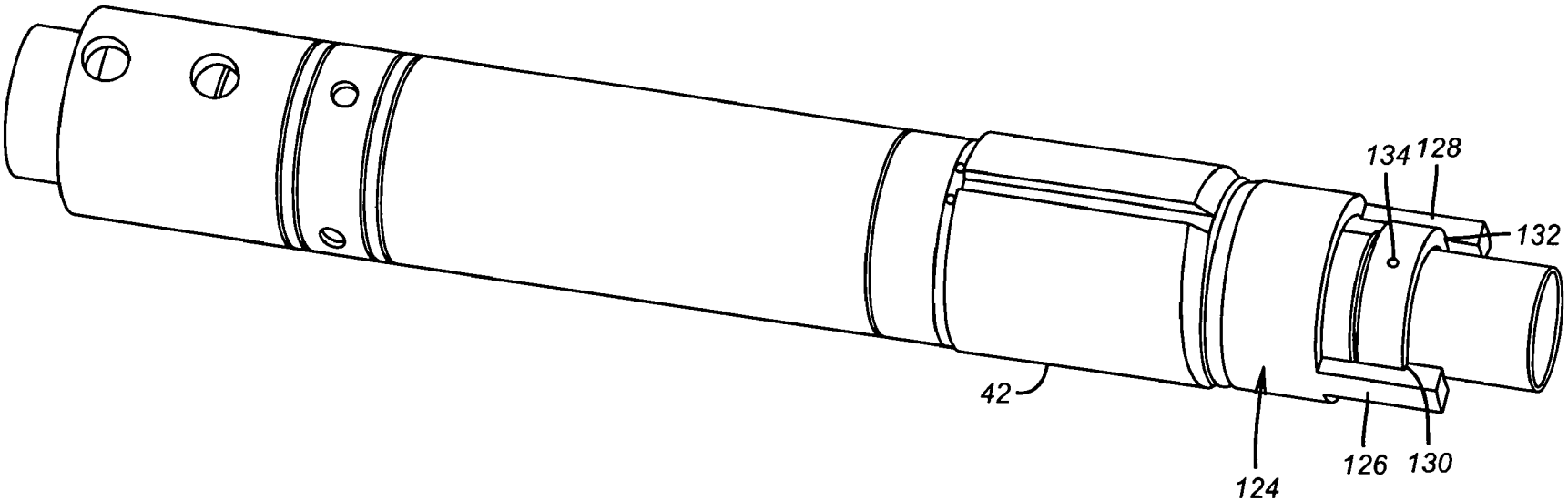
FIG. 8 shows the lower end of the valve in FIG. 1 during assembly to get proper spacing of internal components.

Referring to FIG. 2 a spring 114 is used to push on ring 86 and through the other parts described before downwardly on sleeve 12 to insure engagement of seat 16 with respect to the ball when pressure above the ball 10 is applied. Conversely, sleeve 14 is biased uphole by spring 74 to ensure a similar engagement of the ball and seat when pressure below the ball is applied. As those skilled in the art will appreciate the assembly of parts from shoulder 84 at the upper end to shoulder 118 at the lower end each have their own tolerance and the adjustment available for the position of ring 76 on thread 78 is fairly minimal. As a result, the total dimension of the parts between shoulders 84 and 118 can be determined and the position of ring 76 necessary to give the right preload to the assembled parts also determined before final assembly of top sub 82 and bottom sub 70. FIGS. 7 and 8 show this technique.

Instead of assembling top sub 82 and spring 114 to mandrel 42 an upper gauge 122 is assembled to mandrel 42. When fully threaded on, a shoulder 124 hits ring 86 in nearly the exact spot that shoulder 84 from top sub 82 would normally engage it. At the same time at the lower end in FIG. 8 instead of putting on bottom sub 70, spring 74 or screw 80, a lower gauge 124 is threaded on to mandrel 42. Lower gauge 124 has a pair of arms 126 and 128 that respectively have shoulders 130 and 132 that wind up exactly where shoulder 118 would be when bottom sub 70 is screwed on. Because of the open gaps between arms 126 and 128 there is access to adjustment ring 76 and it can be moved up or down on thread 78 as long as screw 80 is not assembled. Ring 76 is turned to bottom on shoulders 130 and 132 and then the rotation is reversed to allow installation of screw 80 in recess 136 (see FIG. 5) so that ring 76 has its position fixed as close as possible to shoulder 118 when the bottom sub 70 is assembled with spring 74. Similarly, the upper gauge 122 (FIG. 7) is first removed and replaced with top sub 82 and spring 114 (FIG. 2). When the bottom sub 70 and spring 74 get screwed on, spring 74 will have the needed preload since despite the accumulation of tolerances of all the assembled parts the actual surface of ring 76 is determined as it related to spring 74 for the desired preload.

Referring now to FIG. 9 the cage 20 is illustrated as fully assembled. Since it needs to straddle ball 10 and flanges 64 and 66 (FIG. 3) it needs to be made into two pieces. The technique for making this piece or, for that matter, other pieces that need to be made in two pieces to be assembled over yet other pieces, is to make a longitudinal cut 140. Before doing that, all the machining shown in FIG. 9 is done including bores 142 and 144 on one side and similar bores on the other side (not visible) that go though where longitudinal cut 140 will be made. Again, before the cut is made, the bores 142 and 144 are tapped. Thereafter the cut 140 is made by a wire EDM technique. This known technique removes a part of the wall away where the cut is made. Thus, after the cut halves are pushed together, their inside diameter 146 will be smaller than it was before the cut. However, the pitch of the tapped thread and the matching thread on the studs 148 and 150 when screwed in to bridge the cut 140 will, because of the thread pitch separate the halves at cut 140 just enough to compensate for the amount of wall removed during the cut so that when fully assembled the original one piece diameter 146 that was there before the cut is again present. While the wire EDM removes only a few thousandths of an inch out of the wall to make the longitudinal cut the result is still a change in the internal bore dimension. This technique of drilling and tapping before a longitudinal cut with wire EDM allows the original bore dimension to be regained while holding the cut halves together.

Referring to FIG. 2 the lock open feature will be described. Sleeve 12 is ultimately selectively retained by top sub 82. Shoulder 84 contains fixed ratchet ring 86 to prevent upward movement of the ratchet ring 86. Ring 86 has an undercut 88 defining taper 90. Ring 92 initially sits in undercut 88. It has ratchet teeth 94 that, in the position of FIG. 2 are offset from ratchet teeth 96 on ring 86. Ring 92 bears on retainer ring 98 which, in turn, captures split ring 100 in groove 102 of sleeve 12. Due to urging of spring 114, sleeve 12 is held down against ball 10 and against the uphole force on sleeve 14 from spring 74 (see FIG. 5). Locking collar 104 has one or more internal grooves 106 for engagement with a tool (not shown) that will ultimately pull the collar 104 uphole. A shear screw 108 initially secures the collar 104 to the sleeve 12. Sleeve 12 has a groove 110 that eventually registers with tangential pins 112 extending from collar 104. Collar 104 initially retains ring 92 in undercut 88. In operation, the collar 104 is pulled up with a tool (not shown) to break the shear screw 108. As the collar then moves up, tangential pins 112 ride in groove 110 until hitting the top of it at which time the collar 104 moves in tandem with sleeve 12. In the meantime, collar 104 moves uphole from ring 92 allowing it to collapse inwardly to clear taper 90. When pins 112 register with the top of groove 110 and the sleeve 12 is moving with collar 104, ring 100 in groove 102 of sleeve 12 takes with it ring 98 which, in turn now can push ring 92 beyond taper 90 so that ratchet teeth 94 move into engagement with ratchet teeth 96 on ratchet ring 86. The uphole movement described above continues until sleeve 12 hits a travel stop. This happens in two ways depending on the position of ball 10 when sleeve 12 is being pulled up. If the ball 10 is open, as shown in FIG. 3, flange 64 pulls up cage 20 as well as slide 22 which was registered with sleeve 12 at groove 60. The ball 10 comes up with cage 20 because they are connected at trunnions 24. The ball 10 does not rotate because there is no relative movement between the slide 22 and the cage 20. Motion of sleeve 12 stops when ring 32 hits mandrel 42 and that position is held locked by the ratchet teeth engagement of teeth 94 and 96. On the other hand, if ball 10 is in the closed position of FIG. 4, the sleeve 12 will bring up the cage 20 and move it relatively to slide 22. This happens because at the onset of movement of sleeve 12 the upper ring 32 of slide 22 is already close to mandrel 42 and fairly quickly hits it as the sleeve 12 comes up. Further uphole movement of sleeve 12 pulls the cage 20 relative to the slide 22 which causes the pins in slide 22 to rotate ball 10 to open as they register with slots 44 in ball 10. When the cage 20 comes against already stopped ring 32 of the slide 22 uphole motion stops and the position is again locked in by engaging teeth 94 and 96.

Those skilled in the art will recognize that the ball type lubricator valve can be normally operated with control line pressure that moves piston 26 in opposed directions to rotate ball 10 on its own axis for 90 degrees to the open and closed positions. An optional indexing feature holds the open and closed positions when they are attained. The valve can be locked open from either the open position or the closed position by freeing the upper sleeve 12 to move and lifting it until it ratchet locks with the ball 10 in the open position while maintaining a full bore through the valve. While a ratchet lock is illustrated other locking devices such as dog through windows, collets or other equivalent devices are also contemplated. It should be noted that translation of ball 10 is only employed when attempting to lock it open. It should be noted that parts can be reconfigured to alternatively allow the ball 10 to be locked closed as an alternative.

Yet another feature of the barrier valve is the preloading of the internal components and the ability to gauge the dimension of the internal components before mounting the top and bottom subs with the spring or springs that provide the preload so the proper amount of preload can be applied. Yet another feature is a way of making longitudinally split parts so that they retain their original internal dimension despite removal of a part of the wall for a cutting operation using the drill and tap technique before longitudinal cutting by wire EDM and then regaining near the original spacing in the joined halves relying on the pitch of the tapped thread and the fastener inserted in the bore and spanning the longitudinal cut. In this particular tool the cage 20 and slide 22 can be made with this technique. The technique has many other applications for longitudinally split parts with internal bores that must be maintained despite wall removal from a cutting process like wire EDM.

Figure 12:
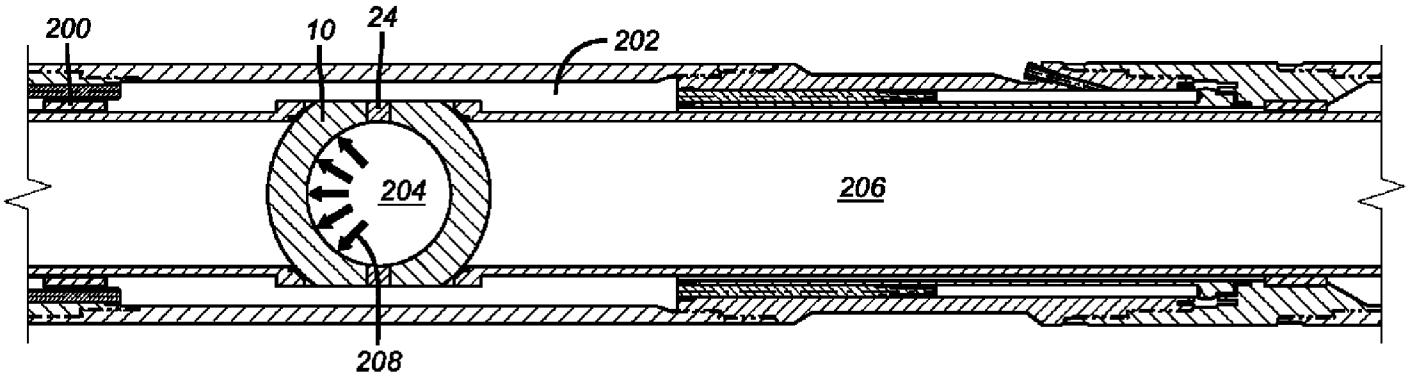
FIG. 12 is a force diagram of the FIG. 1 design showing a condition of a differential force in an uphole direction.
Figure 13:
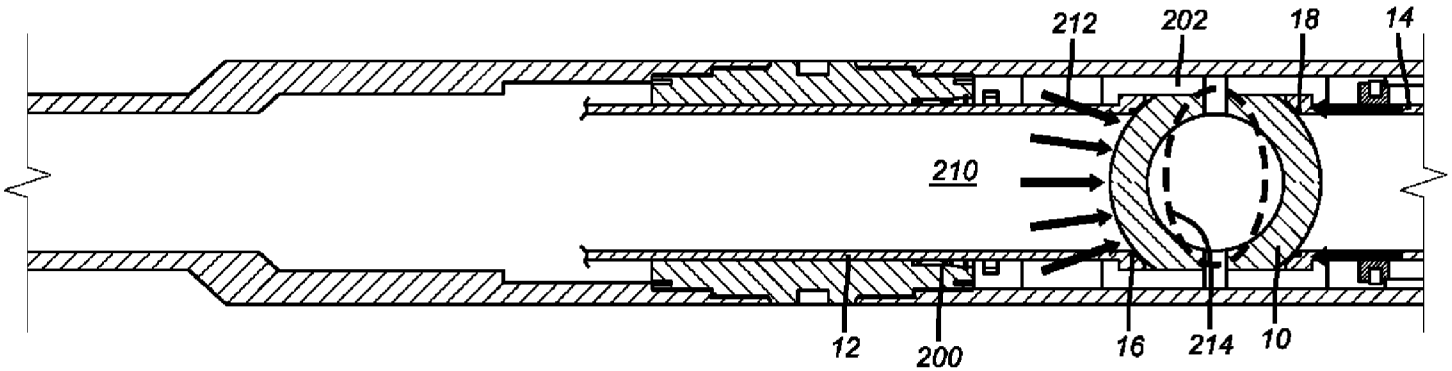
FIG. 13 is the view of FIG. 12 with a differential force in a downhole direction and leakage from ball distortion under high differential pressures.

FIGS. 12 and 13 illustrate what happens under high differential loading conditions in the uphole and downhole directions respectively in the design discussed above and illustrated in FIGS. 1 and 4. In FIG. 12 the ball 10 is in the closed position and holding pressure from below. Upper ball seal 16 is on sleeve 12 and there is an external seal 200 to isolate the annular space 202 which is not sealed from the interior passage 204 of the ball 10 because the pivots 24 are not sealed. Pressure from downhole can come to the ball 10 through the annular space 204 as well as tube 14 since there is no outer seal on tube 14 to isolate the annular space 202. Lower seal 18 that is below the ball 10 is mainly a dust seal as seal 16 is the seal that is intended to hold pressure differential in either direction. When the pressure differential is in an uphole direction as illustrated in FIG. 12 the pressure reaches annular space 202 because there is no exterior seal on tube 14. The uphole directed differential pressure is stopped at seal 200 and seal 16. The downhole pressure enters the passage 204 in the ball to uniformly load the ball 10 from its interior as illustrated by arrows 208. This uniform loading from within the ball 10 helps the ball 10 maintain its shape and contact continues all along the seat 16 for a seal against uphole differential pressure against high differentials of over 10,000 PSI.

In a high downhole oriented differential pressure situation as shown in FIG. 13, something different happens. Here seal 200 isolates such pressure from uphole from getting to the annular space 202 so that the entire differential loading on the ball 10 is from within passage 210 as long as seal 16 is holding. However, at this time the pressure inside the ball 10 at 204 is substantially less so that the pressure in passage 210 represented by arrows 212 can distort ball 10 to an oblong shape as illustrated schematically by dashed line 214. When that happens the seal between the ball 10 and its seat 16 no longer holds and pressure get beyond the ball 10 into the annular space 202 and beyond seat 18 that is meant only to serve as a dust seal as well as down the outside of sleeve 14 because in this embodiment it has no external seal. While the assembly in FIG. 13 has been shown to be perfectly serviceable at lower pressure differentials, testing has indicated the potential for leakage in the manner described above at differentials in the downhole direction in excess of 10.00 PSI.

Figure 14:
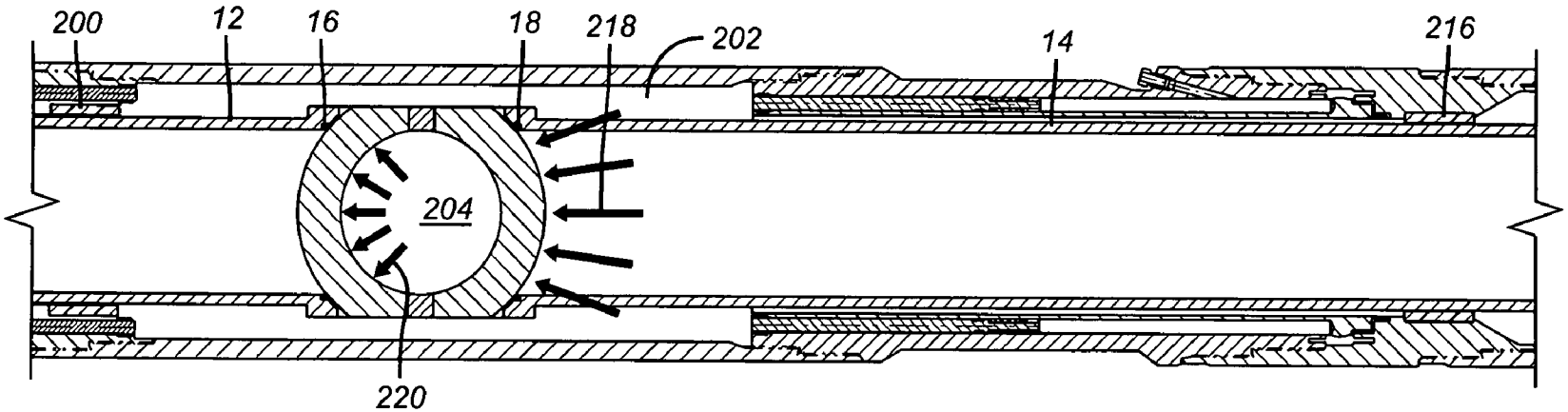
FIG. 14 shows a differential in the uphole direction using a seal on the sleeve above the ball.

In FIG. 14 an additional seal 216 has been added. It blocks pressure from downhole from getting around tube 14 and into annular space 202. Seal 200 is still there on the outside of tube 12. Arrows 218 reflect the initial loading on ball 10 that until a predetermined differential pressure exists can hold the pressure in passage 206 at seal 18. After the differential gets higher the pressure will get by seal 18 by either distorting ball 10 or displacing sleeve 14 away from ball 10. At that time the downhole pressure will get into the annular space 202 as well as within ball 10 at 204. This effect is demonstrated schematically by arrows 220. At this point seal 16 holds the high uphole oriented pressure differential in the manner described before for FIG. 12. Again, even if temporary distortion of ball 10 occurs to let pressure into annular space 202 the deformation is elastic rather than plastic and the ultimate job of sealing against uphole oriented differential pressures falls to seal 16. Once the internal space 204 of the ball 10 is equalized with the pressure from downhole, regardless of the mechanism by which that occurs, the ball 10 is uniformly loaded against seat 16 and as a result even with high uphole differential pressures, there is no leakage uphole past seal 16.

Figure 15:
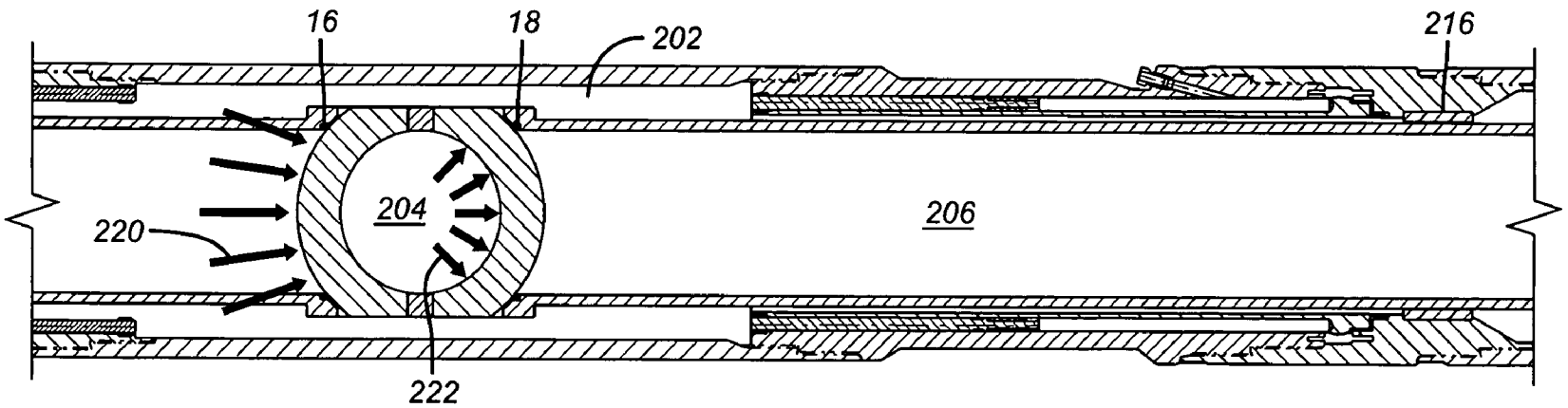
FIG. 15 is the view of FIG. 14 with a differential in a downhole direction showing how leakage is reduced or eliminated under high differentials in a downhole direction and showing an additional seal on the OD of the lower sleeve to assist with sealing.

FIG. 15 is now contrasted with the same situation as shown in FIG. 13. Only this time there is a seal 216 outside of tube 14 and seal 200 is still there above ball 10 and outside sleeve 12 although it is not shown in FIG. 15. A buildup of downhole oriented differential pressure is shown by arrows 220. This differential pressure force at a predetermined level gets past seal 16 temporarily and into annular space 202 and into the ball 10 in space 204. Now the annular space is sealed with seal 216 so pressure in space 204 represented by arrows 222 equalizes with the pressure on ball 10 represented by arrows 220 so that ball 10 is uniformly loaded on seat 18 and seat 18 holds the downhole oriented differential pressure from getting in passage 206. In essence the performance of the assembly under a differential pressure from downhole in FIG. 14 is the same as when the differential is in the opposite direction as shown in FIG. 15. The only difference is which seal holds the differential. In both cases the ball 10 elastically deforms to equalize ball pressure through the annular space 202 and the ball goes right back to its spherical shape once equalization of pressure takes place. This is to be contrasted with the downhole oriented pressure differential situation of FIG. 13 where leakage continued as equalization did not happen and the ball 10 distorted under the differential as indicated by lines 214 and leakage continued as long as the differential pressure on ball 10 existed.

In another aspect of the present invention, it was noticed that in very deep settings of the valve assembly shown in FIGS. 1-9 the annular piston 26 was subject to such high differential forces that its shape distorted in the annular passage that surrounded it and what resulted were wear locations on the surrounding wall that defeated the seals that surrounded annular piston 26 or in extreme cases could distort the piston shape to a sufficient extent to cause it to seize in its bore and become immovable. To counteract this effect noticed when the valve assembly depicted is in very deep applications that involve very high hydrostatic pressures on an annular piston 26, the design was changed to use rod pistons 224 which is in pieces and is exposed to connections 68 and 64 to which a control line (not shown) is connected. Preferably the rod pistons are arrayed symmetrically about the central axis of the valve assembly so that any moment that one such rod piston created can be canceled by another rod piston disposed 180 degrees from it. Any number of rod pistons can be used although an even pairing for symmetry is preferred. The use of rod pistons eliminates the distortion issues at high differential pressures such as existed with annular piston 26. It also makes room to add the seal 216 whose purpose was discussed above. It marks a first for downhole ball valves that are actuated with a rod piston assembly and makes the design useful for very high differential pressure installations where annular pistons can fail under differentials that can exist at differentials above 10,000 PSI. Of course the rod piston design can also be used at lower differentials instead of the annular design with good results.

While the preferred embodiment has been set forth above, those skilled in art will appreciate that the scope of the invention is significantly broader and as outlined in the claims which appear below.

We claim:

1. A downhole valve, comprising:

a housing having a passage therethrough:

a ball having a bore therethrough rotatably mounted to rotate, without translation, on its axis to align and misalign said bore with said passage;

said passage defined by opposed sleeves with seals that remain in contact with said ball as it rotates; and at least one rod piston mounted in a rod piston bore in said housing where said rod piston bore is isolated from said passage and said rod piston is actuated in opposed directions, said rod piston linked to said ball for simultaneous movement with said ball, said piston receiving actuation pressure through said housing, said actuation pressure isolated from pressure in said passage for selective actuation of said rod piston in opposed directions to in turn actuate said ball in opposed directions for aligning and misaligning of said bore in said ball with said passage.

2. The valve of claim 1, wherein:

said at least one rod piston comprises an even number of rod pistons.

3. The valve of claim 1, wherein:

said pistons are symmetrically arrayed around said passage.

4. The valve of claim 1, wherein:

said ball is disposed in said housing defining a surrounding annular space with respect to said ball further defined by an upper sleeve and a lower sleeve in sealing contact with said ball;

said annular space is sealed between said housing and at least one of said sleeves.

5. The valve of claim 4, wherein:

said annular space is sealed with a first seal against said upper sleeve.

6. The valve of claim 5, wherein:

said upper sleeve comprises, adjacent a lower end, a seat with an upper resilient seal that engages said ball.

7. The valve of claim 6, wherein:

said bore in said ball equalizes with pressure from downhole against said ball when said ball closes said passage as said first seal and said upper resilient seal contain pressure from downhole.

8. The valve of claim 7, wherein:

said annular space is sealed against both sleeves.

9. The valve of claim 8, wherein:

said annular space is sealed with a second seal against said lower sleeve.

10. The valve of claim 9, wherein:

said lower sleeve comprises, adjacent an upper end, a seat with a lower resilient seal that engages said ball.

11. The valve of claim 10, wherein:

said bore in said ball equalizes with pressure from uphole against said ball when said ball closes said passage as said second seal and said lower resilient seal contain pressure from uphole.

12. The valve of claim 4, wherein:

said annular space is sealed against both sleeves.

13. The valve of claim 12, wherein:

said annular space is sealed with a second seal against said lower sleeve.

14. The valve of claim 13, wherein:

said lower sleeve comprises, adjacent an upper end, a seat with a lower resilient seal that engages said ball.

15. The valve of claim 14, wherein:

said bore in said ball equalizes with pressure from uphole against said ball when said ball closes said passage as said second seal and said lower resilient seal contain pressure from uphole.

* * * * *